United States Patent [19]

Senno et al.

[11] 4,427,462

[45] Jan. 24, 1984

[54] ELECTRIC APPARATUS AND ITS MAGNETIC CORE OF (100)[011] SILICON-IRON SHEET MADE BY RAPID QUENCHING METHOD

[75] Inventors: Harufumi Senno, Yamatokoriyama; Masayuki Wakamiya, Suita; Yukio Horita, Hirakata, all of Japan

[73] Assignee: Matsushita Electric Industrial Co., Ltd., Osaka, Japan

[21] Appl. No.: 390,132

[22] Filed: Jun. 18, 1982

[30] Foreign Application Priority Data

Jun. 18, 1981 [JP] Japan ..... 56-95023
Apr. 7, 1982 [JP] Japan ..... 57-58883

[51] Int. Cl.[3] ..... H01F 1/04

[52] U.S. Cl. ..... 148/31.55; 29/609; 310/216

[58] Field of Search ..... 310/216–218; 148/112, 31.55; 336/234; 29/609

[56] References Cited

U.S. PATENT DOCUMENTS

| | | | |
|---|---|---|---|
| 3,266,955 | 8/1966 | Taguchi et al. | 148/111 |
| 4,299,622 | 11/1981 | Kimira et al. | 75/123 L |
| 4,337,087 | 6/1982 | Esashi et al. | 75/123 L |
| 4,362,581 | 12/1982 | Kimura et al. | 148/31.55 |

*Primary Examiner*—J. D. Miller
*Assistant Examiner*—D. L. Rebsch
*Attorney, Agent, or Firm*—Burgess, Ryan & Wayne

[57] ABSTRACT

High-silicon steel sheets or ribbons having the crystal texture described by (100)[011] are used for the fabrication of magnetic cores of electrical machinery in such a way that the easy axes of magnetization <001> coincide with the directions of magnetic circuits or lines of magnetic flux. Magnetic cores of, for instance, electric motors or transformers can be remarkably improved in efficiency.

13 Claims, 9 Drawing Figures

ELECTRIC APPARATUS AND ITS MAGNETIC CORE OF (100)[011] SILICON-IRON SHEET MADE BY RAPID QUENCHING METHOD

BACKGROUND OF THE INVENTION

The present invention relates to electrical machinery fabricated from high-silicon steel sheets or ribbons produced by the rapid quenching or melt-spinning process and more particularly magnetic cores thereof.

High-silicon steel sheets or ribbons which are readily available in the market and contain about 3% Si (silicon) have been widely used in the fabrication of magnetic cores of power transformers. The magnetic cores made of especially oriented silicon steel sheets or ribbons with the crystal texture described by the crystal plane (110) and the ribbon long axes [001] have the lowest iron or core loss. Extensive investigations have been made in order to improve the properties of such silicon steels, so that it now becomes almost impossible to reduce the core loss with such silicon steels. However, the iron loss of magnetic cores used at present is still considerable, and in view of energy savings it is a matter of national importance to reduce the core loss. From the standpoint of physical properties of silicon steels, it is preferable to increase the silicon content to, for instance, 6.5% because the intrinsic electric resistivity is increased, the magnetocrystalline anisotropy is decreased, and the magnetostriction becomes zero, so that the iron loss can be remarkably reduced and reduction in noise can be expected. Even though the physical properties can be improved with increase in Si content as described above, one of the very important mechanical properties; that is, ductility, is considerably adversely affected. As a result, it has been extremely difficult or almost impossible to mass produce sheets of such high-silicon steels by conventional rolling.

However, recently the rapid quenching or melt-spinning process has been developed. According to the rapid quenching or melt-spinning process, a molten alloy is made to squirt through a small opening or nozzle onto the surface of a cylinder or disk rotating at an extremely high velocity. The melt of alloy on the surface of the cylinder or disk cools and solidifies very quickly and is drawn into a ribbon. The underlying principle of this process is to cool or solidify the molten alloy at an extremely high cooling rate of $10^{5°}$ to $10^{6°}$ C./sec. As a consequence, the alloy in the liquid state above a liquid temperature is rapidly solidified so that thus prepared alloy is considerably smaller in grain size than the alloys produced by the conventional casting processes and consequently it has a higher degree of ductility even when it contains as much as 6.5% Si. In addition, as compared with the conventional processes for the production of sheet metal through alternate steps of rolling and heat treatment, the rapid quenching or melt-spinning process has a distinctive advantage in that sheet metal can be drawn by a single step and therefore is suitable for mass production of sheet metal.

The inventors prepared various high-silicon steels containing 5–8% Si by the rapid quenching or melt-spinning process and made extensive studies and experiments of their crystal textures. The results of investigation show that the surfaces of such ribbons have the (100) crystal plane, but do not have the zone axes [001] of the longitudinal or axial ribbon direction; that is, they are isotropic in the plane or have the crystal texture which can be described with (100)[0 kl]. Therefore, such ribbon as described above can find various interesting applications in many fields. However, in case such ribbon is used as, for instance, a toroidal magnetic core of a power transformer and the directions of the magnetic fluxes coincide with the longitudinal direction of the sheet, the direction of the magnetic fluxes do not coincide with the magnetic easy direction of the ribbon. Accordingly, the iron losses of the sheet become larger than those of the oriented silicon steel ribbons in which the directions of the magnetic fluxes coincide with the magnetic easy direction <001> of the ribbons.

SUMMARY OF THE INVENTION

The present invention was made to overcome the above and other problems. A first object of the present invention is, therefore, to provide a high-silicon steel magnetic core which has excellent magnetic characteristics and can reduce the iron or core loss.

A second object of the present invention is to provide electrical machinery whose iron loss is a minimum and which has a higher degree of efficiency.

According to the present invention, magnetic core laminations are punched or otherwise formed from a sheet or strip of a high-silicon steel with the (100)[011] crystal texture which is prepared by the rapid quenching or melt-spinning process or the like. The laminations are so punched out that their easy axes of magnetization coincide with the directions of magnetic lines of flux (to be referred to as "the magnetic paths" in this specification for brevity) through the magnetic core.

According to a first embodiment of the present invention, each magnetic core lamination is punched out in such a way that its two magnetic paths which are at right angles to each other are inclined at 45° relative to the axis of easy magnetization and the laminations are stacked into a magnetic core. Therefore, even if the blanks contain 6–8% Si, it becomes possible to employ the high-silicon steel magnetic cores in transformers and electric motors so that their efficiency can be remarkably improved.

DESCRIPTION OF THE EMBODIMENTS

It is well known in the art that rapid quenching has received much attention as a rational method for the production of ribbons, foils or thin strips or sheets of various alloys and makes it possible to produce amorphous alloys. For instance, rapid quenching has been used in the production of high-silicon steel ribbons containing 6.5% by weight Si and such steel ribbons have considerably higher ductility than those produced by the prior art methods. In addition, they have excellent magnetic properties such as lower magnetocrystalline anisotropy and a lower degree of magnetostriction. Therefore, the fabrication of such high-silicon steels into various parts has been long considered, but practical production has not been carried out yet because they are too brittle to be rolled.

Figure 1:
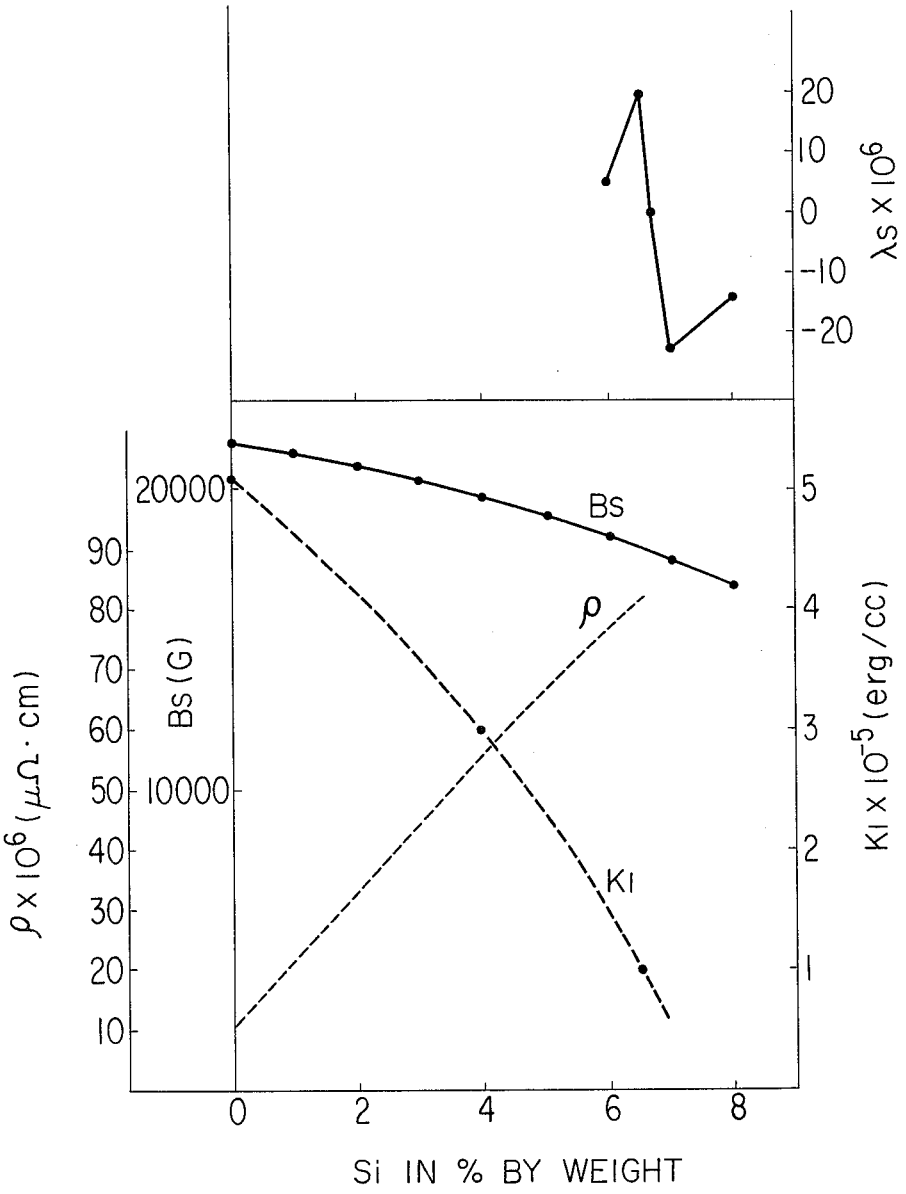
FIG. 1 shows the relationship between the silicon contents in high-silicon steels and the physical properties thereof.

In general, physical properties of silicon steels vary with increase in silicon contents as shown in FIG. 1. It is seen that the higher the Si content, the higher the intrinsic electrical resistivity ($\rho$) becomes and the lower the magnetocrystalline anistropy ($K_1$) becomes. It is, therefore, preferable that if they are used as cores, the higher the Si content, the better. High-silicon steels have a further advantage that the saturation magnetostriction becomes almost zero with a Si content of about 6.5% so that if they are used as cores of transformers, noise can be considerably reduced. However, the saturated magnetic flux density or magnetic induction (Bs) decreases linearly with increase in Si content.

In view of the above, the present invention provides high-silicon steels containing 5–8% silicon which can remarkably reduce the iron loss and noise without causing a decrease in operating magnetic flux density or magnetic induction.

Extensive studies and experiments have been recently conducted in order to employ rapid quenching in the production of high-silicon steel foils or ribbons and the results show that high-silicon steels with a higher degree of ductility can be produced easily.

When a molten alloy is drawn into a thin ribbon by melt-spinning, it gives off heat in the direction of thickness of the ribbon being drawn into a cold disk or rotor. As a result, the crystal growth is predominant in the direction of thickness or <100> and consequently isotropic in the longitudinal or axial direction of the ribbon drawn. This has been confirmed by the X-ray diffraction analysis. If such ribbon is wound in the form of a toroidal core of a power transformer, the direction of magnetic flux becomes that of the isotropic or the axial direction. As a result, the operating point or the magnetic flux density at which no waveform distortion occurs drops and the core loss becomes higher as the operating point becomes higher.

The inventors made extensive studies and experiments on rapidly quenched high-silicon steels and found out that the ribbon's plane is (100) and crystallographically isotropic in the plane. More specifically, it was found that the direction of easy magnetization <100> is inclined by 20°±5° in the longitudinal direction of the ribbon relative to the direction of thickness thereof. Moreover, it was found out that when the rapidly quenched ribbons are subjected to heat treatment, the following two types of crystal textures are obtained depending upon the compositions of the atmosphere used:

| | | |
|---|---|---|
| (I) | (100)[011] | at low vacuum |
| (II) | (110)[$\bar{1}$10] | at high vacuum |

Heat treatment of ribbon typically causes the [011] orientation in the longitudinal or axial direction of the ribbons. When the ribbons with the above-described crystal textures are used, for instance, as the core of a power transformer or a motcr, the core loss can be reduced and consequently the efficiency can be increased. However, it is essential that (a) the stator of a motor must be so designed that the direction of magnetic flux coincides with the axis of easy magnetization; (b) the armature must be so designed that the magnetic path established by a magnetic flux coincides with the easy axis of magnetization; and (c) the magnetic path through the core of a power transformer must coincide with the easy axis of magnetization.

Figure 2:
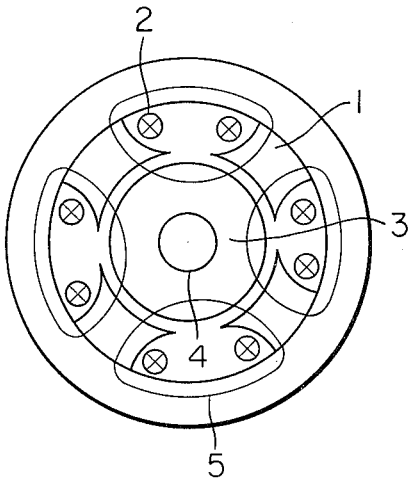
FIG. 2 shows an electric motor in section.

FIG. 2 shows a typical DC machine and reference numeral 1 denotes a stator which is made of rapidly quenched high-silicon steel films, defines magnetic poles and establishes a field magnetic path; 2, field windings; 3, an armature; 4, commutator; and 5, magnetic paths. Both the stator 1 and armature 3 are made of rapidly quenched high-silicon steel and are so designed and constructed that the magnetic circuits 5 coincide with the easy axes of magnetization of the rapidly quenched high-silicon steel ribbons.

Figure 3:
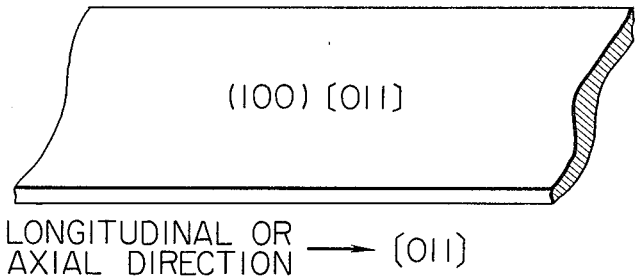
FIG. 3 shows a part of a sheet or strip of a high-silicon steel which is prepared by the rapid cooling or melt-spinning process or the like and which has the crystal texture described by (100)[011]
Figure 4:
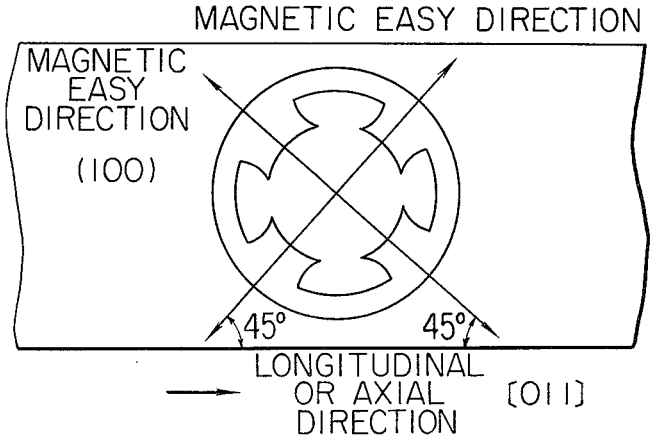
FIG. 4 shows how a core lamination is punched out from the blank as shown in FIG. 3.

More specifically, a steel ribbon with the crystal texture of (100)[011] as shown in FIG. 3 and the Si content of 6.7% by weight is punched or otherwise shaped in such a way that the axes of the magnetic poles are inclined by 45° relative to the longitudinal or axial direction of the ribbon as shown in FIG. 4. The punched laminations or core elements are laminated into a stator.

The torque T of a direct-current motor is proportional to the product of the field magnetic flux $\phi$ and the armature current I. Since the axes of the magnetic poles coincides with the easy axes of magnetization, a small current can produce a high magnetic flux, so that a high torque can be produced.

Figure 5:
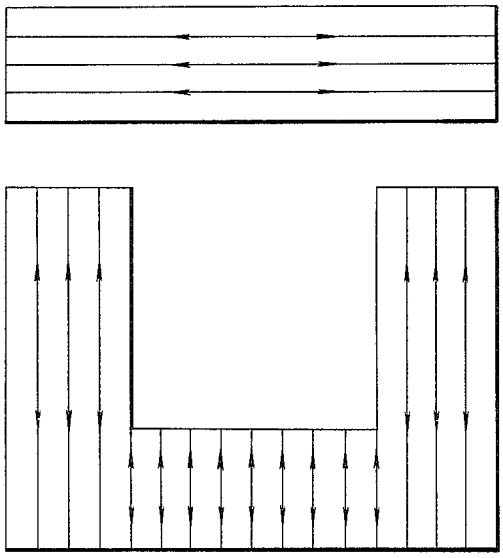
FIG. 5 PRIOR ART
FIG. 5 shows the easy axes of magnetization of "U" and "I" shaped magnetic core laminations punched out from an isotropic silicon steel blank.

In the case of power transformers, uniaxially oriented silicon steels with the (110)[001] crystal texture are widely used. In FIG. 5, the arrows show the easy axes of magnetization of "U" and "I" laminations of a transformer core. The "I" shaped laminations are punched in the rolled direction while the "U" shaped laminations, in the direction parallel with the rolled direction. As a result, of the four sides of arms of the laminated core, only three coincide with the easy axes of magnetization and consequently the core loss is rather high.

Figure 6:
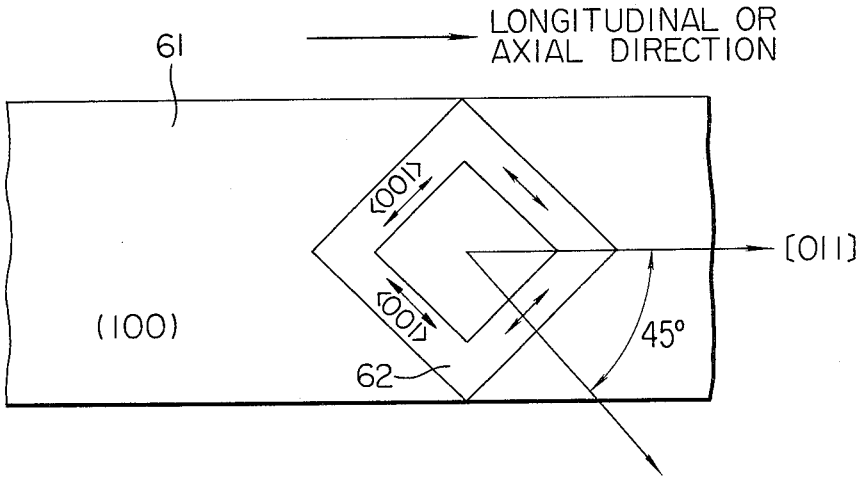
FIG. 6 shows how a magnetic core lamination is punched out from the blank as shown in FIG. 3 according to the present invention.

However, if a core lamination is punched out from a high-silicon steel ribbon with the (100)[011] texture as shown in FIG. 6, the easy axes of magnetization all coincide with the directions of magnetic flux as indicated by the double-pointed arrows and consequently the core loss can be considerably reduced. Reference numeral 61 denotes a high-silicon steel ribbon or sheet with the (100)[011] crystal texture; and 62, a magnetic core lamination punched out.

Next, some examples of the present invention will be described in detail.

EXAMPLE 1

Core laminations of the stator of an electric motor were punched out, as shown in FIG. 4, from a rapidly quenched high-silicon steel ribbon or film which contains 6.5% Si and has the (100)[011] crystal texture. The laminations were annealed at 1000° C. in the argon atmosphere and then stacked into a magnetic core or stator. The stator laminations were also fabricated from an isotropic silicon steel. The motors with the former and latter stators are referred to as "A" and "B", respectively, for brevity and their torques were compared. The torque ratio Tr was $$Tr = \frac{\text{torque of motor "}A\text{"}}{\text{torque of motor "}B\text{"}} = 1.5$$

In other words, the torque of the motor in accordance with the present invention is improved by 50% over the prior art motor.

EXAMPLE 2

Figure 7:
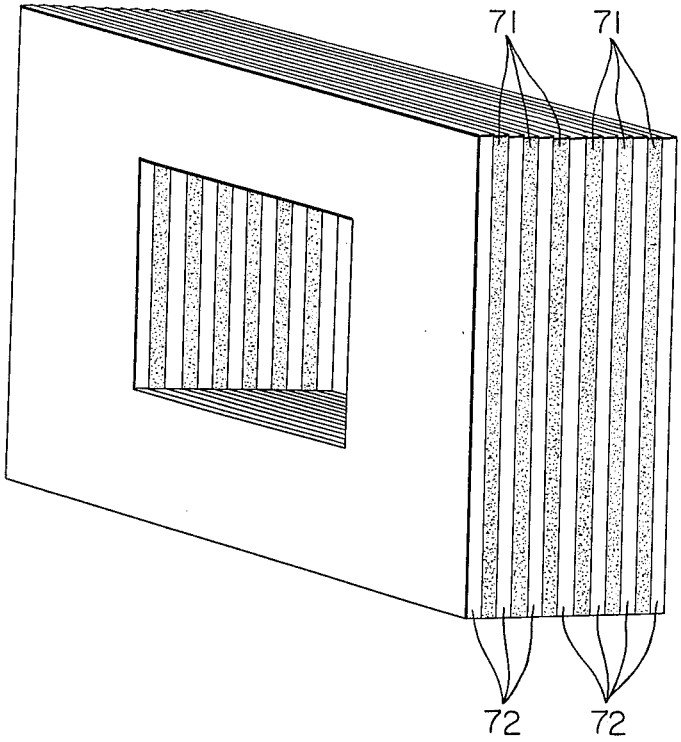
FIG. 7 is a perspective view of a first embodiment of a magnetic core in accordance with the present invention.
Figure 8:
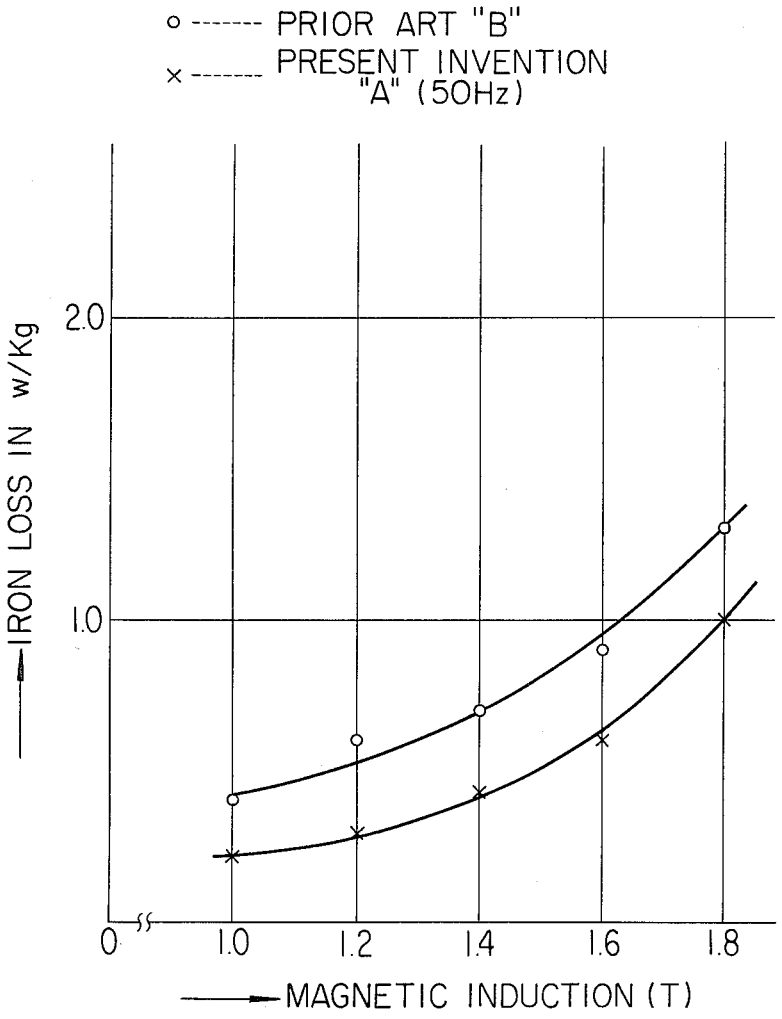
FIG. 8 shows the comparison in iron loss between the magnetic cores according to the present invention and the prior art.

Transformer core laminations were punched out, as shown in FIG. 6, from a rapidly quenched high-silicon steel ribbon or film which contained 6.6% Si and had the (100)[011] crystal texture. The core laminations 72 and insulating laminations 71 were alternately stacked one upon another as shown in FIG. 7 to provide a laminated transformer core. For the sake of comparison, a conventional highly isotropic silicon steel was used to provide a transformer core. The former is referred to as the transformer "A" and the latter, as the transformer "B". The core losses of the transformers "A" and "B" are shown in FIG. 8 and the noise test data, in Table 1.

TABLE 1

| | Noise (dB) |
|---|---|
| Prior art transformer core "B" | 0* |
| Transformer core "A" of the invention | −4 |

Remarks:
The noise level of the prior art transformer core "B" is taken as "0".

EXAMPLE 3

Figure 9:
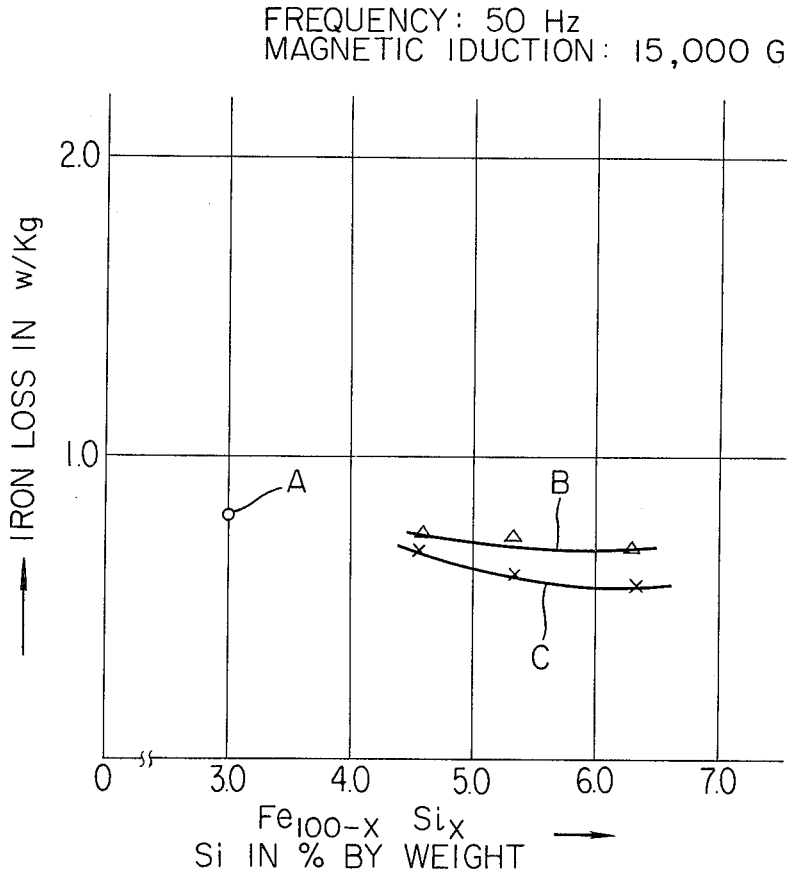
FIG. 9 shows the relationship between the silicon contents in % by weight of the magnetic cores in accordance with a second embodiment of the present invention and their core loss.

This example shows the relationship between the Si content in % by weight and the core loss as shown in FIG. 9.

Core laminations were punched out from high-silicon steel sheets which were 0.10 mm in thickness and are expressed by $Fe_{100-x}Si_x$, where x=4.6, 5.3 and 6.3. The core laminations and insulating laminations were alternately stacked into the magnetic cores.

In FIG. 9, the point A indicates the iron loss of the magnetic core comprising laminations stamped out from a highly isotropic silicon steel 0.3 mm in thickness. The curve B shows the core loss of the magnetic core comprising the laminations punched out of isotropic high-silicon steels $Fe_{100-x}Si_x$. The curve C indicates the iron loss of the magnetic cores in accordance with the present invention.

In summary, when high-silicon steels with the (100)[011] crystal texture are used in the fabrication of electric machinery such as motors or transformers, excellent effects, features and advantages can be attained.

What is claimed is:

1. A rapidly quenched silicon steel magnetic core for electric machinery characterized in that high-silicon steels with the {100}<011> crystal texture are used.

2. A rapidly quenched silicon steel magnetic core for electric machinery as set forth in claim 1 further characterized in that said high-silicon steels contain 6 to 8% by weight of silicon.

3. A rapidly quenched silicon steel magnetic core for electric machinery as set forth in claim 2 further characterized in that said magnetic core is so designed and constructed that the magnetic path thereof coincides with the easy axes of magnetization of said high-silicon steels.

4. A rapidly quenched silicon steel magnetic core for electric machinery as set forth in claim 3 further characterized in that said magnetic core is so designed and constructed that its magnetic paths are inclined by 45° relative to the longitudinal or axial direction of said high-silicon steel ribbons.

5. An electric motor characterized in that the magnetic poles thereof are made of a rapidly quenched high-silicon steel ribbons with the (100)[011] crystal texture.

6. An electric motor as set forth in claim 5 further characterized in that said magnetic poles contain 6 to 8% by weight of silicon.

7. An electric motor as set forth in claim 6 further characterized in that the magnetic paths of said magnetic poles coincide with the easy axes of magnetization of said high-silicon steel ribbons.

8. An electric motor as set forth in claim 7 further characterized in that the magnetic paths through said magnetic poles are inclined by 45° relative to the longitudinal direction of said high-silicon steel ribbons.

9. A transformer characterized in that its core is made of a rapidly quenched high-silicon steel ribbons with the (100)[011] crystal texture.

10. A transformer as set forth in claim 9 further characterized in that said core contains 6 to 8% by weight of silicon.

11. A transformer as set forth in claim 10 further characterized in that the magnetic path through said core coincides with the easy axes of magnetization of said high-silicon steel ribbons.

12. A transformer as set forth in claim 11 further characterized in that the magnetic paths through said core are inclined by 45° relative to the longitudinal direction of said high-silicon steel ribbons.

13. A magnetic core for electric machinery characterized by being fabricated from a rapidly quenched high-silicon steel with the (100)[011] crystal texture.

* * * * *